United States Patent [19]

Ripley et al.

[11] Patent Number: 4,976,278

[45] Date of Patent: Dec. 11, 1990

[54] METHOD AND APPARATUS FOR INTRODUCING AND POSITIONING A TANK CONTENTS REMOVAL MEANS

[75] Inventors: Ian Ripley; Anthony H. Needham, both of Cleveland, United Kingdom

[73] Assignee: Great Eastern (Bermuda) Ltd., New York, N.Y.

[21] Appl. No.: 464,867

[22] Filed: Jan. 16, 1990

[30] Foreign Application Priority Data

Feb. 1, 1989 [GB] United Kingdom ..... 8902171

[51] Int. Cl.[5] ..... F04B 23/00

[52] U.S. Cl. ..... 137/15; 137/565; 417/361

[58] Field of Search ..... 137/565, 15; 417/360, 417/361, 900

[56] References Cited

U.S. PATENT DOCUMENTS 2,792,158 5/1957 Veitch, Sr. et al. ..... 417/361 X 3,880,553 4/1975 Wolford et al. ..... 417/361 X 3,938,545 2/1976 Nagy et al. ..... 417/360 X 4,476,886 10/1984 Nishkanen et al. ..... 137/565 X

*Primary Examiner*—John Rivell

*Attorney, Agent, or Firm*—George A. Skoler

[57] ABSTRACT

A method and apparatus for introducing and positioning a removal means, such as a pump, through a manway to the interior of a tank which contains a flowable material, such as black oil residues, which is to be removed by the removal means in a manner which provides for the ease of moving and positioning the removal means as well as providing a support therefore is disclosed. The invention utilizes a telescoping means which is coupled to the removal means and which provides support for the removal means as well as facilitating its movement and where desired, can also be connected to a power source for supplying the force necessary to move the removal means into and within the tank.

23 Claims, 6 Drawing Sheets

METHOD AND APPARATUS FOR INTRODUCING AND POSITIONING A TANK CONTENTS REMOVAL MEANS

RELATED PATENT APPLICATIONS

This application is related to the following commonly assigned patent applications which were filed on the same date as this application:

U.S. application Ser. No. 07/464,859, filing date Jan. 16, 1990.

U.S. application Ser. No. 07/464,873, filing date Jan. 16, 1990.

U.S. application Ser. No. 07/464,866, filing date Jan. 16, 1990.

BRIEF DESCRIPTION OF THE INVENTION

A method and apparatus for introducing and positioning a removal means, such as a pump, through a manway to the interior of a tank which contains a flowable material which is to be removed by the removal means, such as black oil residues, in a manner which provides for the ease of moving and positioning the removal means, as well as providing a support therefore. The invention utilizes a telescoping means which is coupled to the removal means and which provides support for the removal means as well as facilitating its movement and where desired, can also be connected to a power source for supplying the force necessary to move the removal means into and within the tank.

BACKGROUND TO THE INVENTION

In the course of handling crude oil and refined petroleum products, the small percentage of residues which are present accumulate in storage holding areas because with time in storage such residues separate from the basic crude oil or the refined petroleum. The amounts of these residues that accumulate depends on the crude oil or refined petroleum being stored. Complicating this condition is the fact that in one way or another, water and siliceous materials are introduced to the holding areas and accumulate with the residues. These residues have fuel value. However, gaining access to them within the holding areas is difficult until the holding area is free of its normal storage, and even then, the recovery of the residues is a problem. In the past, after the area was free of the normal storage, crews were sent into the area and they shoveled the residues out. Vacuum suction has been used to remove the separate layer of water either before or after the work crews entered the area. Because the resolution of this problem was so labour intensive and hazardous, and carried out irregularly, there has been a lessened inclination to clean the storage holding areas, consequently many of them have large accumulations of such residues and water. This has introduced a massive problem for the refiner which involves serious economic and enviromental penalties.

Owing to an inability to recover these residues effectively and economically and to render them useful as fuels, residues of crude oil and/or heavy fuel oil, and the like, have low commercial value. They commonly have high viscosities, and contain, among other things, insoluble carbonaceous particulate matter, sand, other inorganic particulate materials and/or water. As a result, they have been discarded into pits or ponds which over time have become serious enviromental problems and imposed significant problems in land utilization.

The complexity of the problem deserves a more thorough discussion. Crude oils, heavy fuel oils, and the like, are typically stored in holding tanks having a capacity of from about $2.5\times10^5$ to $15\times10^6$ gallons or more. They may be left in the tank for weeks at a time, consequently insoluble residues have ample opportunity to precipitate within the oil in the tank and settle to the bottom of the tank where the insoluble residues may become assimilated with any water layer present.[1] With time, the volume occupied by these residues (and sludges) within the storage tank becomes appreciable. This volume will continue to build with each succeeding charge of oil into the storage tank thereby reducing the storage volume of the tank for the desirable crude oils and heavy fuel oils.

[1] Water has a higher specific gravity than oil and settles to the bottom of the tank.

Eventually, either to maximize and restore the holding capacity of the tank or to empty the tank for purposes of inspection or repair, and the like considerations, these residues (sludges) have to be removed from the tank. As mentioned earlier, the problem had been met by workers entering the tank through its manways or an upper opening (e.g., top cover), and proceeding to shovel the sludge out of the tank. Not only is this primitive technique labour intensive, and time consuming, resulting in an inordinate amount of downtime for the tank, it also creates serious health and environmental problems. Other sludge removal techniques have been developed including, for example, vacuum suction utilizing negative pressure, dilution with a solvent such as light gas oil/distillate, and the like. While these techniques are perhaps improvements over manual recovery of residues from tanks, they are expensive and still pose health, safety and ecological problems. They give little thought to recovering and treating the removed residues in an economical and efficient manner. In addition, the use of solvents adds a significant cost since the solvent has value in commerce.

The residues shoveled or otherwise taken from the tanks have been carted in batch operations from the tank storage areas to large excavated holes in the ground where they are deposited to create pits or ponds of such residues. These residues eventually transform into pitch. With time, the pits or ponds have grown into substantial enviromental headaches for the refiners and their purlieus.

As the value of petroleum has increased in the past decade, coupled with recognition that the accumulation of residues is a problem that will not go away, and has to be dealt with, more interest has been taken in the energy values of the residues because only in the effective utilization of the residues as a fuel or raw material can the enviroment be cleaned up. Key to energy value attractiveness of these residues are two factors:

1. low cost recovery of the residues from the tanks;
2. low cost purification of the residues which allows them to be blended off either as a fuel or as a refinery raw material.

However, inasmuch as access to these tanks is generally accomplished by means of the manways, which are typically located at the lower portions of the side(s) of the tanks, residue removal techniques, regardless of the specific procedure employed, have generally been carried out on a frequent enough time interval so as to prevent the height of the accumulating residue material within the tank from reaching a level which is higher than the height of the manway location which would, of course, present serious problems in gaining access to the tank and the contained residues.

A need accordingly exists for a process which provides an economical and efficient means for removing crude oil and/or heavy fuel oil residues, and the like, from a storage tank in a safe and ecologically sound manner and which provides for the recovery of such removed residues such that they can be economically utilized. A need also exists for the ability to gain access to a tank through its manway so as to provide means by which such removal is effected even when the height of the material within the tank is completely above the height of the upper portion of the manway and to then be able to introduce and position the removal means within the tank.

THE INVENTION

The invention relates to a method and apparatus for introducing and positioning a means for the removal of at least a portion of the contents of a tank, such as black oil residues, into and within the interior of a tank through one of its manways. The introduction and positioning of the removal means is facilitated by the utilization of a telescoping means which provides a plurality of functions. The telescoping means, which is coupled to the removal means, provides support for the removal means during insertion and positioning, facilitates ease of movement of the removal means, and if desired, is the means by which the removal means is moved when a power supply is connected to the telescoping means.

More particularly, the method comprises introducing and positioning a removal means into the interior of an enclosure containing flowable material for the removal of at least a portion of the flowable material, which enclosure has a passageway with one end of the passageway communicating with the interior of the enclosure and its other end communicating with the exterior of the enclosure, said removal means being positioned within the passageway and said other end of the passageway terminating with one or more opening means which allows access from the exterior of the enclosure to the interior of the passageway comprising:

(a) moving the removal means towards the one end of the passageway communicating with the interior of the enclosure and introducing the removal means into the enclosure and introducing the removal means into the interior of the enclosure while being supported by a telescoping means which is coupled to the removal means and which is pivotally mounted at the other end of the passageway which communicates with the exterior of the enclosure;

(b) positioning the removal means in the interior of the enclosure in a horizontal plane and along the longitudinal axis of the passageway by extending or retracting the telescoping means; and (c) positioning the removal means in the interior of the enclosure in a vertical plane which is substantially perpendicular to the said horizontal plane wherein, as a result of such vertical positioning, the telescoping means is pivoted about its pivotal mount.

In a preferred embodiment of the invention, the removal means is a positive displacement submersible pump. In another embodiment of the invention, the telescoping means is connected to a power source such that activation of the power source results in the extension or retraction of the telescoping means and the concomitant movement of the removal means for the positioning thereof. In yet another preferred embodiment of the invention, the removal means, such as the submersible pump, is provided with plurality of wheels with which the removal means is able to move and which wheels act as guide members which are movably coupled with a telescoping track comprised of nested rectangularly shaped component lengths which form an interior channel and in which the guide member wheels are positioned.

DETAILED DESCRIPTION OF THE INVENTION

Figure 1:
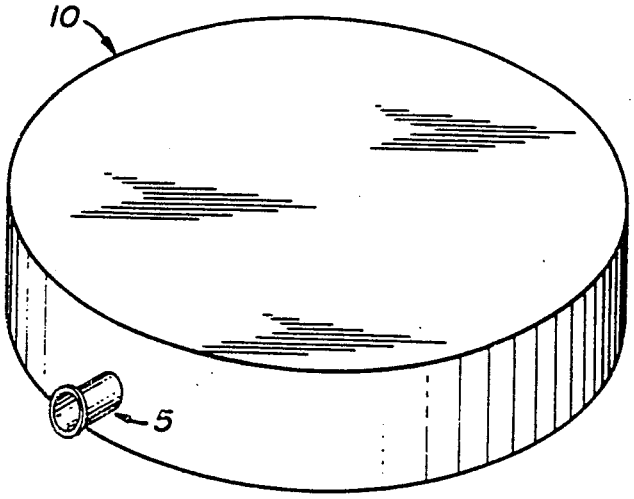
FIG. 1 is a schematic diagram of a storage tank showing a side mounted manway.

Overall, this invention may be part of a system directed to the economical and efficient recovery of black oil residues, such as crude oil and/or heavy fuel oil residues, and the like, comprising sludges, slop oils, pitches, waxes, bottoms, and the like, which typically build up in crude oil/heavy fuel oil storage tanks. This system includes a novel technique for gaining access to the tank for the introduction of the residue removal means through the tank's manway, even when the oil content of the tank is at a height which is above the height of the manway, without significant loss of the contents of the tank thereby providing the initial step of the system for the removal of the residues. This novel technique for gaining access to the tank through one of its manways is discussed in detail in copending U.S. application Ser. No. 07/464,859. The present invention is specifically directed to the method of actually introducing and properly positioning the residue removal means into and within the interior of the tank once access is gained into the tank's manway.

The system of which this invention is a part, is a process for the economic and efficient recovery of black oil residues from storage tanks and avoids substantially all of the disadvantages noted above. As a result of this process, oil is recovered from the residue of the tank which, when blended with crude oils at predetermined rates, is suitable in every respect for use as a refinery feedstock.

Generally, this system is discussed in detail in copending U.S. application Ser. No. 07/464,873, and involves a first step of thermal mobilization of the residue materials with a hot circulating liquid heating medium, preferably water, which is introduced to the interior of the tank. This heating of the residue material with the liquid heating medium lowers its viscosity and thereby enables the residue removal means, such as a submersible pump, to remove the residue at an optimum pumping and recovery rate.

In view of the relatively high viscosity and possible high solids/sludge content of the residue to be recovered, it is most desirable to have the residue removal means introduced directly into the tank thereby reducing to zero the suction length, in contrast to prior art techniques, thus greatly increasing the handling rate.

The resultant mobilized residue contents of the tank are then continuously removed and fed to a separation zone for the removal of the entrained liquid heating medium and particulate matter. The separation zone may comprise strainers, decanter centrifuges, centrifugal centrifuges, and the like. If desired, chemical additives may be employed in the separation zone to assist in the removal of the liquid heating medium, particularly when the medium is water; to reduce the pour point of the recovered hydrocarbons; and to stabilize the hydrocarbons to improve their compatibility with the virgin crude oil with which the recovered and treated hydrocarbons are blended.

The overall process of this system provides an efficient and economical means to release and recover the entrapped hydrocarbon residues from the tank bottoms and brings a source of additional revenue to a refinery in contrast to the prior art in which those same refineries have had to expend considerable sums for the removal and safe disposal of these residues.

By virtue of this overall system, the amount of downtime that a storage tank is subjected to in order to remove its residue content is reduced to a fraction of the time that is conventionally required. Moreover, this system does not require the need for personnel to enter the tank. That feature along with the use of a closed loop system for thermally mobilizing and removing the residue from the tank presents an environmentally safe process for both the ecology and the personnel involved.

Figure 2:
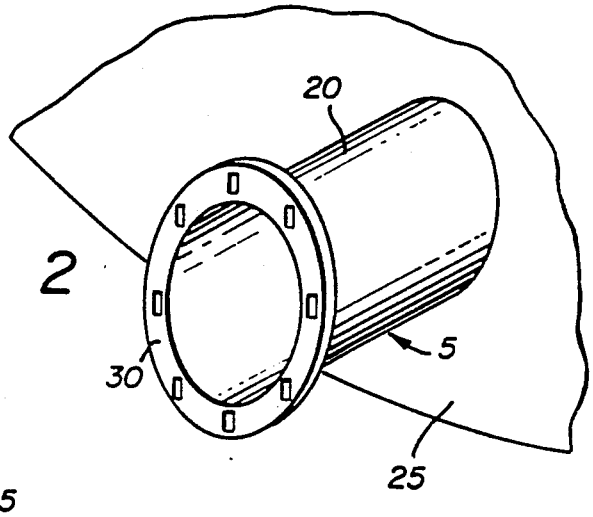
FIG. 2 is a close-up view of the manway shown in FIG. 1.
Figure 3:
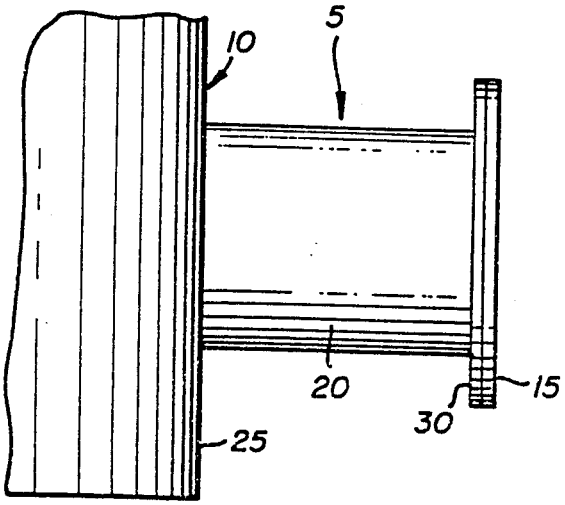
FIG. 3 is a schematic side view of the manway and tank shown in FIGS. 1 and 2.

In order to carry out the system it is necessary to be able to gain access to the interior of the tank so as to be able to introduce the liquid heating medium to induce mobilization of the residue and, most importantly, to be able to introduce the residue removal means, such as the submersible pump. The manways of the tank are generally designed to accommodate manual entry and accordingly are of a size which can easily accept the introduction of the heating means as well as the removal means of the overall process. Such a manway is schematically shown in FIG. 1 in which manway 5 is mounted on the side of tank 10. A close-up view of the manway of FIG. 1 is shown in FIG. 2 with a side view thereof shown in FIG. 3. As shown in these Figures, manway 5 typically comprises an entry neck which is secured to sidewall 25 of tank 10. Manway flange 30 is an integral part of entry neck 20 and is the means to which the cover plate 15 is secured to the manway. The problem, however, is being able to remove cover plate 15 of the manway, which is typically just a "blind flange", i.e., a continuous plate with no openings that communicate with the interior of the tank, and replace it with an adapter which can house the removal means and through which the liquid heating medium can also be introduced, without an appreciable loss of the contents of the tank, even when such contents is at a level in the tank which is above the height of the manway.

This problem is solved by the technique of first inserting a blanking plate between the cover plate and the manway flange to which the cover plate is secured and securing the blanking plate to said flange. The cover plate is then removed while the blanking plate is still in position and effectively retains the contents of the tank in place. The adapter is then placed in position and secured to the manway flange as well. The blanking plate is then removed and the recovery process is ready to begin.

Figure 4:
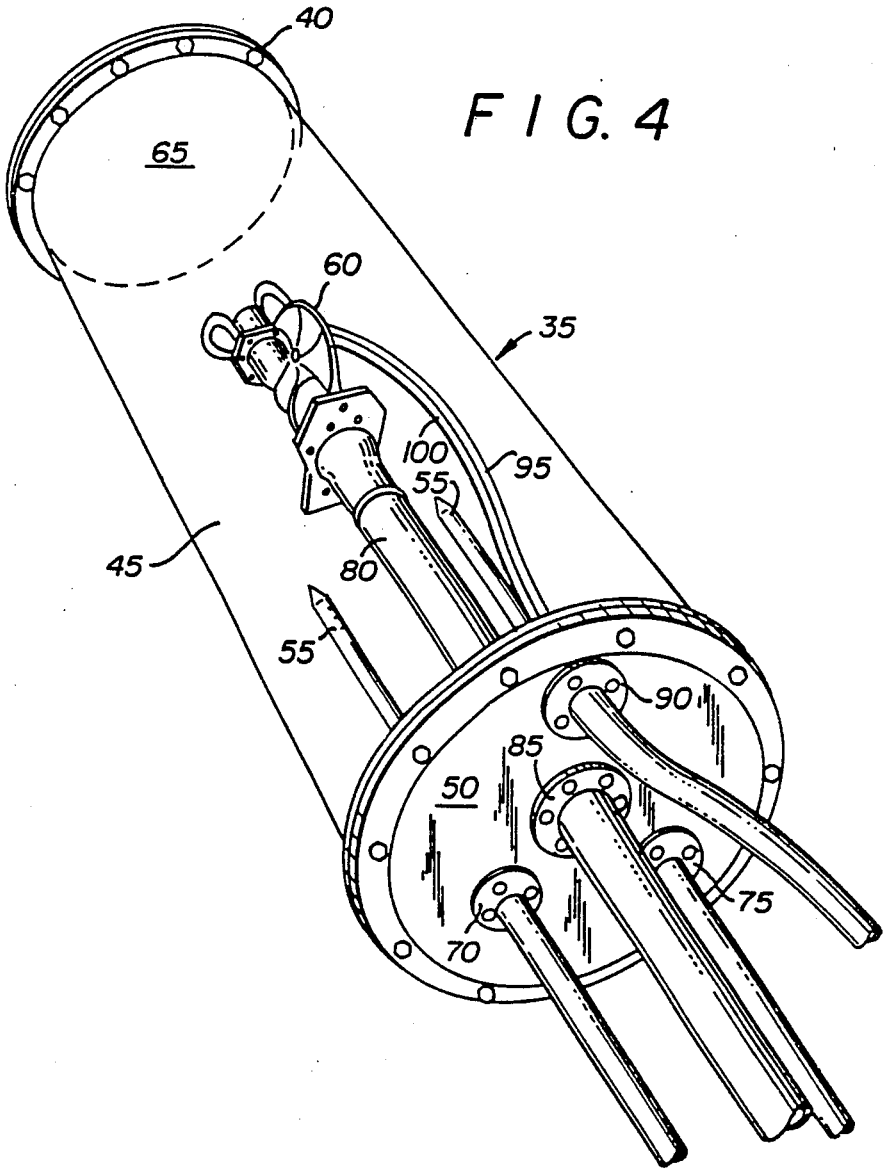
FIG. 4 is an isometric view of an adapter which is affixed to the manway of a tank and which shows the presence of a heating means and a removal means within the housing of the adaptor.

Reference is made to FIG. 4 in which an adapter 35 is shown having an adapter flange 40 which is essentially identical to and preferably mates with manway flange 30. This is to ensure that the adapter will provide a good and effective seal with the manway flange. While it is preferred that the adapter flange be coextensive and mate with the manway flange, it is not necessary that it do so.

Adapter 35 is comprised of a housing 45 and a front face 50. Housing 45, in accordance with the present invention, is equipped with heating means 55 and residue removal means 60, which in FIG. 4 is shown as a submersible pump representing the preferred embodiment of the invention. The housing 45 of the adapter and the entry neck 20 of the manway together form a passageway which leads directly into the interior of the tank. Thus, the heating means and/or removal means may be directly introduced into the tank through back face 65 of the adapter which is open, free communicates with, and allows complete access to the interior of the tank.

Front face 50 of adapter 35 is provided with opening means which allow for communication between the outside of the tank and the interior of the adapter ultimately leading to the interior of the tank itself. These openings may be comprised of valves, seals, or other conventional opening means which are well known to those skilled in the art. In FIG. 4, seals 70 and 75 allow for the conduits of heating means 55 to enter the adapter thereby enabling the introduction and withdrawal of the liquid heating means which is continuously recirculated through these conduits by a pump (not shown) which passes the cooler, withdrawing liquid heating medium to a heat exchanger (not shown) so that it may be suitably reheated for reintroduction into the tank. Seal 90 allows for the passageway of hydraulic lines 95 and 100 which provide for the inlet and outlet of hydraulic fluid to drive removal means 60.

The removal means 60 is provided with a discharge conduit 80 which is slideably engaged in seal 85.

As the heating medium is circulated into and out the tank and is directly and intimately contacted with the residue material, more and more of the residue material becomes mobilized. Generally, after about 4 to 8 days (for a tank of about $5\times10^6$ to about $20\times10^6$ gallons), the temperature of the lower portion of the residue material is just about in equilibrium with the temperature of the heating medium. At least in the case of water, a mobilized residue layer is thus formed floating on top of a water layer and forming a mobilized residue/water interface.

The present invention is specifically directed to introducing and positioning the residue removal means into and within the tank such that the inlet end of the removal means is desirably located slightly above the interface formed between the heating medium, such as water, and the mobilized residue material. In this manner, the minimum quantity of water is entrained with the withdrawn material while that part of the residue material which is the most mobilized is still withdrawn due to is close proximity to the generally hotter water layer. Although the removal of mobilized residue material has been featured through the discussion of the invention thus far, it should be understood that the present invention is not limited to only the removal of such material from a tank. Indeed, any flowable material contained within an enclosure is capable of being removed by the system of the invention.

A particularly desirable residue removal means is an Archimedian screw-type, self-cleaning pump sold by the Environmental Division of A B Pharos Marine, Gothenburg, Sweden. Such a pump typically can weigh about 20 to 35 kg. and will therefore provide a relatively high moment when positioned within the tank taking into account this weight of the pump and the distance that the pump is introduced into the interior of the tank. As such, a means needed to be developed which would not only facilitate the proper positioning of the pump but would also provide an effective support for this pump while it is in the passageway formed by the adapter/manway assembly and, most importantly, while it is in the interior of the tank itself. So too, if desired, this means could also incorporate the force necessary to actually drive the removal means into and out of the tank. In accordance with the present invention, such a means is a telescoping means which is coupled to the removal means and pivotally mounted at the end of the end of the passageway which communicates with the exterior of the tank.

It is to be noted that, as will be discussed below, the telescoping means of the present invention in and of itself does not represent any new mechanical device and indeed represents conventional telescoping devices well known to those skilled in such art. What is novel is the use of such a telescoping device in the manner described herein and of the way such telescoping device is mounted in the apparatus of the present invention.

Figure 5:
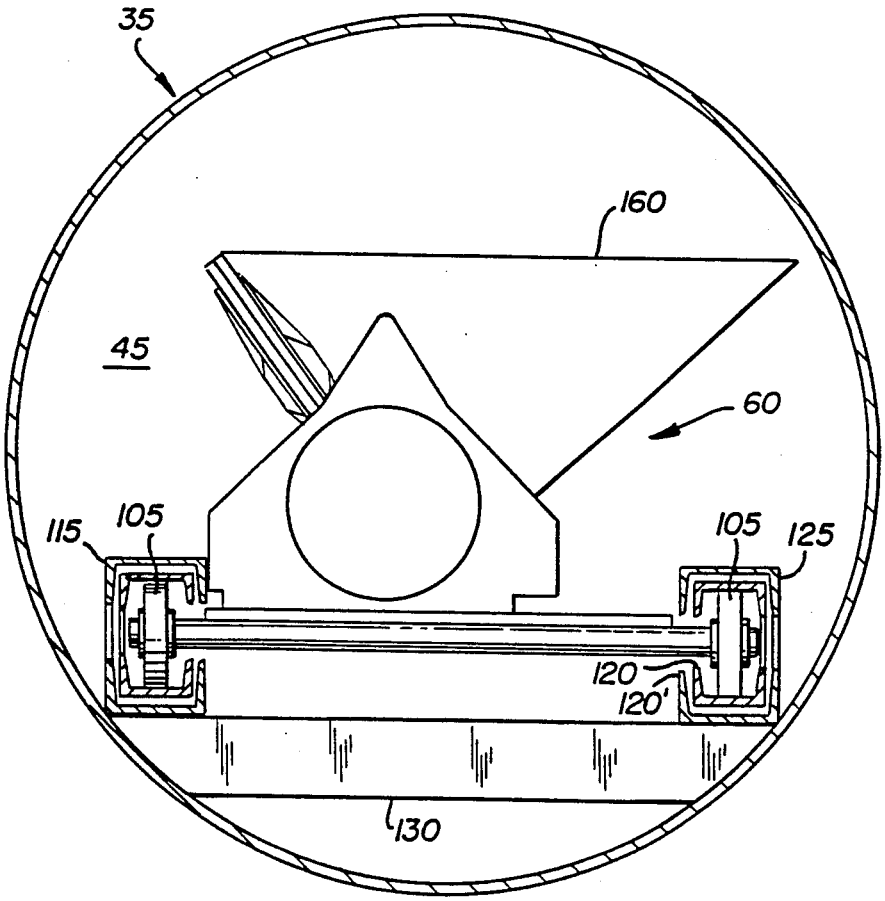
FIG. 5 is a cross-sectional end view of one embodiment of the present invention in which a removal means is inside of an adapter which removal means is supported by a telescoping means in accordance with the invention.
Figure 6:
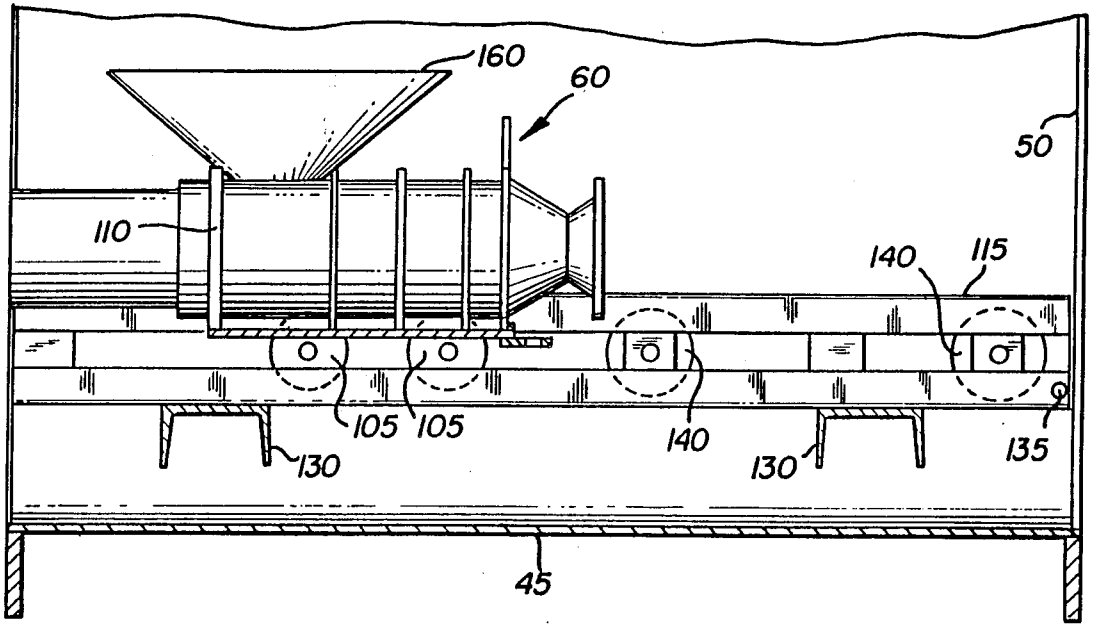
FIG. 6 is a cross-sectional front view of the embodiment shown in FIG. 5.
Figure 7:
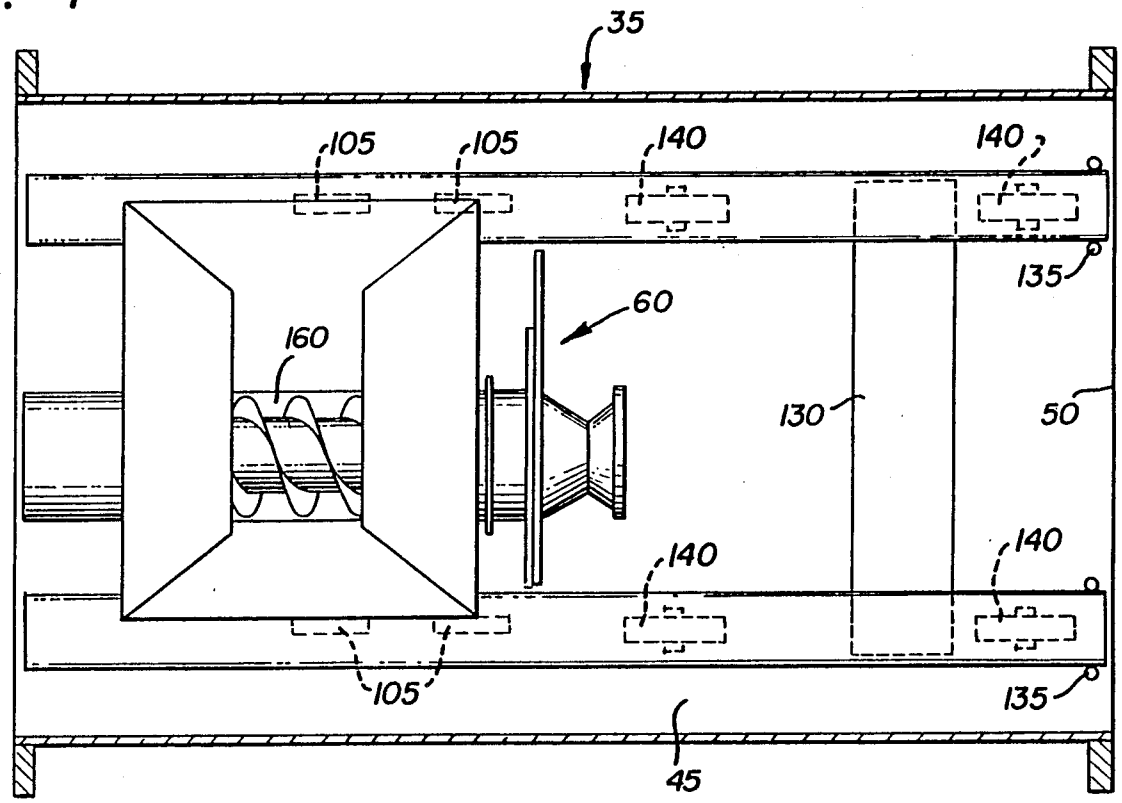
FIG. 7 is a top view of the embodiment shown in FIG. 5.

Reference is made to FIGS. 5, 6 and 7 in which a submersible pump is shown coupled to a telescoping means within an adapter in accordance with the present invention wherein FIG. 5 is an end view, FIG. 6 is a side view and FIG. 7 is a top view of the pump and telescoping assembly in which the same reference numerals are used throughout the drawings. As used herein, a "telescoping means" may comprise a telescoping track alone or a telescoping track used in conjunction with one or more guide members which are movably coupled with the telescoping track. Thus, the telescoping means will be considered coupled to the removal means if a telescoping track is secured thereto or alternatively one or more guide members are secured thereto which guide members are then, in turn, movably coupled with the telescoping track.

In particular, in FIGS. 5 through 7, the removal means 60, in this case, a submersible pump having an inlet hopper 160, is provided with plurality of guide members 105 which, in this case, are wheels secured to the pump by means of trolley assembly 110. The guide members 105 are movably coupled to a telescoping track which can best be seen in FIG. 5. As shown therein, telescoping track is comprised of a series of nested substantially rectangular lengths 120 and 120' wherein the dimensions of length 120 are less than that of 120' such that they can be arranged in a conventional telescoping arrangement with one another. The nested rectangularly shaped lengths form a channel 125 in which guide member wheels 105 are located and with which they are movably coupled.

As in any conventional telescoping track assembly, a force that is applied to track 115 such that it becomes telescoped and extended will also cause movement of removal means 60 in the same direction of extension due to the coupling of guide member wheels 105 within the track. Similarly, a force applied to removal means 60 will cause movement of the guide member wheels which in turn will cause corresponding movement in the telescoping track to which the wheels are movably coupled. It is accordingly not critical to the present invention whether a power supply such as hydraulic power, manpower, compressed gas power, and the like, which is provided through openings in front face 50 of the adapter is applied to the telescoping track or to the removal means itself in order to provide the necessary force to actually move the removal means in the direction desired inasmuch as either mode will be suitable.

The telescoping track 115 freely rests on supports 130 which are located inside of the housing of the adapter and which help position the removal means such that its longitudinal axis is substantially parallel, if not coincident, with the longitudinal axis of adapter 35.

Whereas the end of the telescoping track closest to tank 10 is coupled to the removal means, the end of the track closest to front face 50 of adapter 35 which end communicates with the exterior of the tank is pivotally mounted by pins 135. As will be discussed below, these pivotal mounts allow for the vertical positioning of the removal means once it has been introduced into the interior of the tank.

Wheels 140 in telescoping track 115 act somewhat like bearings and facilitate movement of one rectangular length within the other in a conventional manner.

The telescoping track need not be in the substantially rectangular shape shown in the embodiment of FIGS. 5, 6 and 7. Indeed, any geometrical shape which may be provided in a telescoping manner such that one length is nested within another and cooperatively engaged with one another in a conventional manner so as to be able to provide a continuous elongated length when extended will be quite suitable in the present invention. Hence, telescoping rails, pipes, and the like are all applicable as being utilized as a telescoping track in accordance with the present invention.

Figure 8:
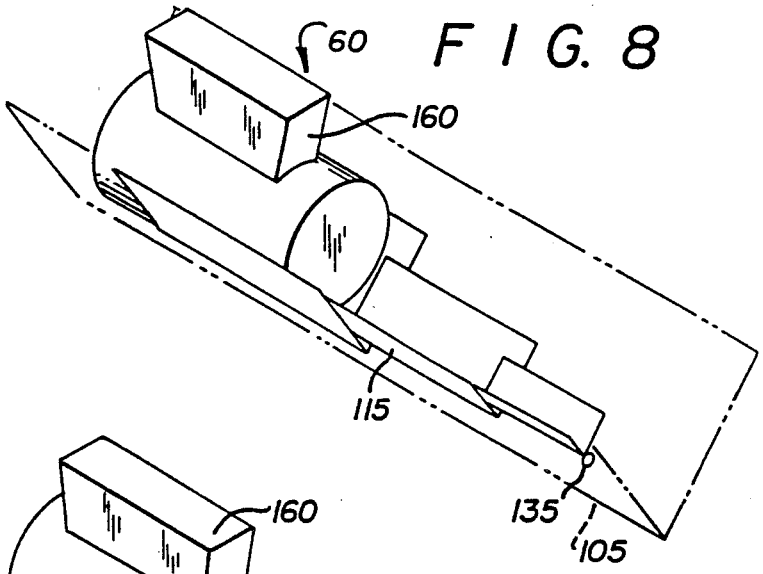
FIG. 8 is an isometric view of another embodiment of the present invention which shows another type of telescoping means affixed to the removal means which is located in an adaptor.

Moreover, the telescoping means need not always comprise one or more guide members which are affixed to the removal means and which are thereby coupled to the telescoping track. Thus, in an alternative embodiment of the present invention, as shown in FIG. 8, the telescoping track, instead of the guide members, is what is affixed to the removal means, which track is simply guided in a guide member. More particularly, FIG. 8 shows another type of telescoping track which is comprised of a V-shaped (U-shaped applicable too) troughs nested one within the other to form a conventional telescoping arrangement. Here, the telescoping V-shaped track is directly coupled to the removal means 60 at one end and pivotally mounted by pins 135 at its other end which is closest to front face 50 of the adapter. Guide member 105 is slideably engaged with the telescoping V-shaped track and merely serves to guide the track as it is extended or retracted by a power source which may be connected either to the track itself or to the removal means. In this embodiment, guide member 105 remains stationary at all times.

Figure 9:
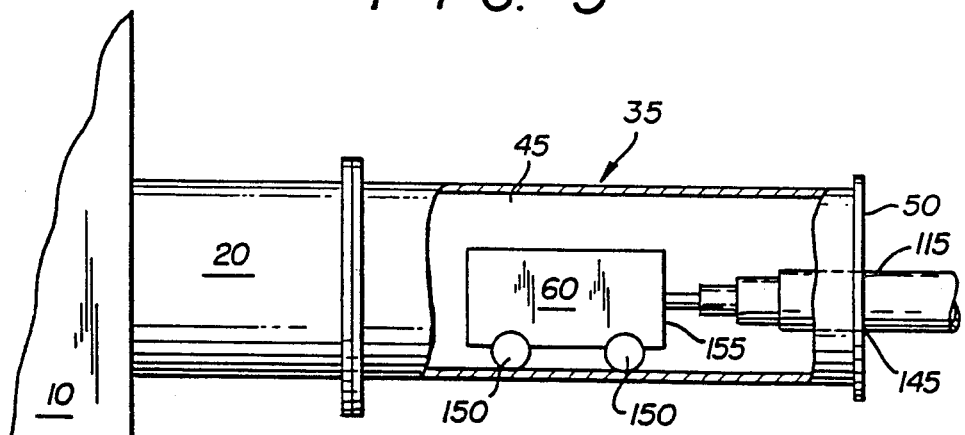
FIG. 9 is a schematic diagram of yet another embodiment of the present invention showing another type of telescoping means affixed to the removal means which is located in an adapter.

As noted earlier, the telescoping means of the present invention may simply comprise a telescoping track. In such an embodiment, the track does not operatively engage with a guide member. Such an embodiment is shown in FIG. 9. Here, telescoping track 115, this time a telescoping pipe, is coupled to the removal means 60 at its rear end 155. In fact, there is no restriction as to where the telescoping track may be coupled to the removal means, i.e., at its sides, on top, underneath, and the like, and with or without guide members which are movably coupled therewith, provided that the telescoping track may be effectively extended and retracted when desired.

In the embodiment shown in FIG. 9, the telescoping track is pivotally mounted at seal 145 in front face 50 of adapter 35. In other words, it is not necessary that the pivotal mount of the telescoping track be actually located within the adapter. It is quite suitable to provide such a pivotal mount in an appropriate, conventional seal which will facilitate vertical movement of the removal means once it is introduced into the interior of tank 10.

The wheels 150 which are affixed to removal means 60 do not engage with the telescoping track 115 and merely facilitate ease of lateral movement.

Once again, a power source may be applied either to removal means 60 or to telescoping track 115 in order to provide the force to actually move removal means into and within tank 10.

Figure 10:
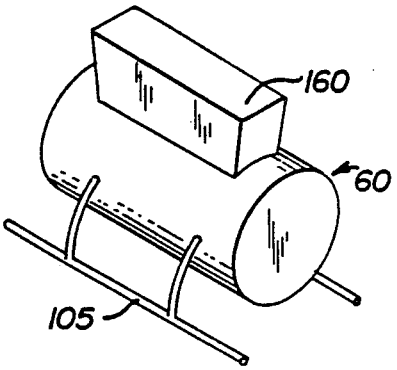
FIG. 10 is an isometric drawing showing another embodiment of the present invention in which a different guide member is shown which guide member movably couples with a telescoping track to form a telescoping means.

Furthermore, the one or more guide members which may be movably coupled with the telescoping track such that lateral movement of one causes lateral movement of the other need not only comprise the wheels 105 shown in FIGS. 5, 6 and 7. Indeed any guide member which may be movably coupled to a telescoping track and which would be conventional for use in a telescoping track may be utilized herein. Such guide members may include balls, blades, and the like, and runners such as those shown in FIG. 10. Such a runner 105 could be movably coupled with a telescoping track such as the one shown in FIGS. 5 through 7.

The embodiment shown in FIGS. 5 through 7 is particularly preferred inasmuch as this type of telescoping means arrangement provides the optimum in control and guidance in being able to easily return the removal means into the adapter from the interior of the tank without its getting hung up at the sides of the manway, particularly the bottom thereof, due to its weight.

Regardless of the specific arrangement of telescoping means utilized, what is required is that one end of the telescoping track be coupled, directly or indirectly (by means of a guide member) to the removal means and that the other end of the telescoping track be pivotally mounted.

Moreover, what is also needed is that at least the telescoping track be of a suitable construction such that it is able to effectively provide support for the removal means. This support is necessary during the introduction of the removal means into the tank, during positioning of the removal means within the tank, and during the actual pumping of the flowable material through the removal means at which time the removal means will generally be in a stationary position for a considerable length of time while positioned deep inside the tank such that the telescoping track may be fully extended. During all of these activities, the telescoping track must be able to keep the removal means at a fixed, desired position. Accordingly, it is preferred that the telescoping track be constructed from a rigid material such as stainless steel, and the like, which will not only provide the necessary strength and rigidity but which will also not be susceptible to attack by the somewhat corrosive residue material.

The removal means is introduced into the tank by activating a power means which causes a force to be applied to either the removal means itself or to the telescoping means. The telescoping means is accordingly extended in the direction of the interior of the tank along the longitudinal axis of the adapter in which the removal means is housed. By controlling the degree of extension or retraction of the telescoping means, the position of the removal means in a horizontal plane and in the direction of the longitudinal axis of the adapter is fixed.

Figure 11:
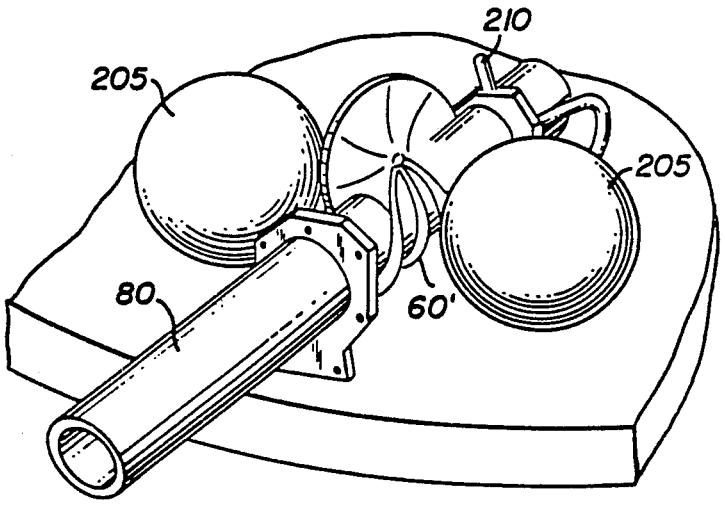
FIG. 11 is an isometric drawing showing a flotation device affixed to the removal means for providing vertical positioning of the removal means within the tank.

The removal means is positioned in the vertical plane, which plane is substantially perpendicular to the above noted horizontal plane, by activating a power source which provides a force in the upward and downward direction. In a preferred embodiment, as shown in FIG. 11, the removal means is moved in a vertical plane by inflating or deflating flotation bags 205 which are affixed to the removal means. These flotation bags are inflated by introducing compressed air or nitrogen, for example, through conduit 210 passing through a seal (not shown) in front face 50 of adapter 35 and can thereby accurately raise or lower the removal means accordingly. Of course, it is not necessary that flotation bags be used to provide the force necessary to raise or lower the removal means. Any conventional means for raising or lowering the removal means such as a cable connected from the top of the tank to the removal means, and the like, may be suitable for use in the present invention.

The ability of being able to vertically position the removal means while still providing the necessary support therefore is brought about by virtue of pivotally mounting the telescoping track which enables it to simultaneously be moved in the vertical plane as well.

Advantageously, in yet another embodiment of the present invention, instead of being simply fixedly mounted the removal means may desirably be mounted on the telescoping means in a manner such that it is able to be rotated around its own vertical axis and/or be able to be moved in a clam-like manner on a fulcrum mounting.

What is claimed is:

1. A method for introducing and positioning a removal means into the interior of an enclosure containing flowable material for the removal of at least a portion of the flowable material, characterized that the enclosure has a passageway with one end of the passageway communicating with the interior of the enclosure and its other end communicating with the exterior of the enclosure, said removal means being positioned within the passageway and said other end of the passageway terminating with one or more opening means which allow access from the exterior of the enclosure to the interior of the passageway, and employing the steps of:

(a) moving the removal means towards the one end of the passageway communicating with the interior of the enclosure and introducing the removal means into the interior of the enclosure while being supported by a telescoping means which is coupled to the removal means and which is pivotally mounted at the other end of the passageway which communicates with the exterior of the enclosure;

(b) positioning the removal means in the interior of the enclosure in a horizontal plane and in a direction along the longitudinal axis of the passageway by extending or retracting the telescoping means; and (c) positioning the removal means in the interior of the enclosure in a vertical plane which is substantially perpendicular to the said horizontal plane wherein, as a result of such vertical positioning, the telescoping means is pivoted about its pivotal mount.

2. The method of claim 1, wherein the removal means comprises a submersible pump.

3. The method of claim 1, wherein the telescoping means is comprised of a telescoping track.

4. The method of claim 3, wherein the telescoping means additionally comprises at least one guide member.

5. The method of claim 4, wherein the at least one guide member is secured to the removal means and is movably coupled to the telescoping track.

6. The method of claim 4, wherein the at least one guide member is secured to the passageway and the telescoping track is coupled to the removal means wherein at least one guide member and the telescoping track are movably coupled with one another.

7. The method of claim 4, wherein the at least one guide member is secured to the removal means and the telescoping track is pivotally mounted to the passageway, wherein at least one guide member and the telescoping track are movably coupled with one another.

8. The method of claim 3, wherein a power means is connected to the telescoping track such that activation of the power means causes the extension or retraction of the track to horizontally position the removal means in the enclosure.

9. The method of claim 8, wherein the power means is a hydraulic drive.

10. The method of claim 9, wherein hydraulic drive conduits for passage of the hydraulic fluid pass through the opening means located at the end of the passageway communicating with the exterior of the enclosure.

11. The method of claim 5, wherein a power means is connected to the removal means having the at least one guide member which is movably coupled to the telescoping track wherein activation of the power means to cause lateral movement of the removal means also causes extension or retraction of the telescoping track.

12. The method of claim 1, wherein the removal means is positioned in the vertical plane by inflating or deflating a flotation device which is affixed to the removal means.

13. An apparatus for introducing and positioning a removal means into the interior of an enclosure containing flowable material for the removal of at least a portion of the flowable material, characterized that the enclosure has a passageway with one end of the passageway communicating with the interior of the enclosure and its other end communicating with the exterior of the enclosure, said removal means being positioned within the passageway terminating with one or more opening means which allow access from the exterior of the enclosure to the interior of the passageway comprising:

(a) a telescoping means supporting the removal means and coupled therewith which is pivotally mounted at the end of the passageway which communicates with the exterior of the enclosure;

(b) a first power means for moving the removal means in a horizontal plane and in a direction along the longitudinal axis of the passageway; and (c) a second power means for moving the removal means in a vertical plane which is substantially perpendicular to the said horizontal plane.

14. The apparatus of claim 13, wherein the removal means comprises a submersible pump.

15. The apparatus of claim 13, wherein the telescoping means is comprised of a telescoping track.

16. The apparatus of claim 15, wherein the telescoping means additionally comprises at least one guide member.

17. The apparatus of claim 15, wherein the at least on guide member is secured to the removal means and is movably coupled to the telescoping track.

18. The apparatus of claim 17, wherein the at least one guide member is secured to the passageway and the telescoping track is coupled to the removal means wherein the at least one guide member and the telescoping track are movably coupled with one another.

19. The apparatus of claim 17, wherein the at least one guide member is secured to the removal means and the telescoping track is pivotally mounted to the passageway, wherein the at least one guide member and the telescoping track are movably coupled with one another.

20. The apparatus of claim 13, wherein the first and/or second power means is a hydraulic drive.

21. The apparatus of claim 20, wherein hydraulic drive conduits for passage of the hydraulic fluid pass through the opening means located at the end of the passageway communicating with the exterior of the enclosure.

22. The apparatus of claim 13, wherein the a flotation device is affixed to the removal means to enable vertical positioning of the removal means.

23. The apparatus of claim 13, wherein the telescoping means is pivotally mounted in a seal of the opening means of the end of the passageway.

* * * * *